US007421944B1

(12) United States Patent
Flaum et al.

(10) Patent No.: US 7,421,944 B1
(45) Date of Patent: Sep. 9, 2008

(54) STRAP JOINT ROTATOR WITH PIVOTING LINKAGE AND PINCH WHEEL

(75) Inventors: Russell M. Flaum, Lincolnshire, IL (US); Darryl M. Devine, Huntley, IL (US); Roy J. Jensen, Pleasant Prairie, WI (US); Wesley P. Nowakowski, Arlington Heights, IL (US); Richard G. Newman, Burlington, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/056,811

(22) Filed: Mar. 27, 2008

(51) Int. Cl.
*B65B 13/02* (2006.01)

(52) U.S. Cl. ..... 100/3; 100/26; 100/29; 100/33 R; 53/589

(58) Field of Classification Search ..... 100/3, 100/8, 26, 29, 30, 33 R, 33 PB; 53/589
See application file for complete search history.

(56) References Cited

U.S. PATENT DOCUMENTS 3,720,158 A * 3/1973 Sauer et al. ..... 100/4
5,644,978 A 7/1997 Jaenson et al.
6,487,833 B1 12/2002 Jaenson et al.
6,536,336 B1 3/2003 Jaenson et al.
6,584,892 B2 7/2003 Flaum et al.
6,755,123 B2 6/2004 Flaum et al.
7,127,986 B2 * 10/2006 Daniel et al. ..... 100/26
7,389,723 B1 * 6/2008 Bullington ..... 100/3

OTHER PUBLICATIONS

Specification, Claims, Abstract and drawings from U.S. Appl. No. 11/782,120 filed Jul. 24, 2007 (commonly owned).

* cited by examiner

*Primary Examiner*—Jimmy T Nguyen
(74) *Attorney, Agent, or Firm*—Mark W. Croll; Donald J. Breh; Levenfeld Pearlstein, LLC

(57) ABSTRACT

A strap joint rotating assembly is for use with a strapping machine. The strapping machine has a feed head for feeding the strapping material into the strapping machine, a strap chute through which the strapping material is passed and a sealing head to seal overlapping courses of the strapping material to one another to define a strap loop having a seal and defining a strap loop plane. The strap joint rotating assembly includes a driven wheel having an axis of rotation generally perpendicular to the strap loop plane and a pinch wheel that has an axis of rotation and is carried on a wheel block. The wheel block pivots to move the pinch wheel into and out of the strap loop plane. The pinch wheel, when in the strap loop plane, has its axis of rotation parallel to the axis of rotation of the driven wheel. The pinch wheel is further movable toward the driven wheel to pinch the strap between the driven wheel and the pinch wheel. The driven wheel is driven to rotate the strap loop around the load.

19 Claims, 9 Drawing Sheets

STRAP JOINT ROTATOR WITH PIVOTING LINKAGE AND PINCH WHEEL

BACKGROUND OF THE INVENTION

The present invention is directed to a strap joint rotator. More particularly, the present invention is directed to a strap joint rotator having a pinch wheel with a pivot linkage used with a strapping machine for compressible materials.

Strapping machines are known for securing straps around compressible loads such as cotton bales or other textile materials. To properly contain the bales, multiple straps are often used, e.g., fed, tensioned and sealed around the load, to create the baled load. Typically, such bales are strapped with plastic strap material.

A strapping machine that is used to conform the bale includes a frame on which the various strapping components are mounted. Several separate but interdependent feed and sealing or strapping heads, strap chutes and other components for positioning the multiple straps around the load are mounted to the frame. Each strapping unit operates in conjunction with each other unit so that the strapping occurs simultaneously at each of the several units. In this manner, the strapping operation is carried out in an efficient and time effective operational mode.

The baling machine includes a hydraulic press that compresses the bale prior to strapping the bale. As such, with the bale compressed prior to strapping, the bale is much more stable. An upper or compression platen forms part of the upper strap chute leg and the strapping components are mounted within a side leg of the strap chute. To effect baling, the upper platen contacts and compresses the load (which completes or closes the strap chute around the load), strap is fed through a sealing head, through the chute around the load, and back to the sealing head. At the sealing head overlapping courses of strap are sealed to one another, the strap is cut from its source (supply) and the compression platen is moved away from the bale to allow the bale to expand.

As the compression plate or platen is released, the material expands to "fill" the loop created by the sealed strap. As such, the expanding material creates a stress (a strain) in the strap. The stress is higher in the direction of expansion of the load. Moreover, the side of the bale is often that portion of the bale that is the "bottom" of the load for purposes of shipping, handling and storage. As such, given that the seal is formed at the side of the bale, the seal may be at that portion of the strap that is in a higher stress area and is in contact with the ground or other object and can possibly be damaged.

To address these concerns, one strapping (baling) machine is configured with a device that repositions the strap on the load. The device, which is a strap joint rotator, repositions the strap to relocate the seal along the bottom or top of the load to reduce the stress that is exerted on the strap joint. Such a strap joint rotator uses multiple driven assemblies, mounted to a shifting carriage. The carriage moves the assemblies into and out of the strap path subsequent loop formation and prior to expansion of the load. Such a strap joint rotator is disclosed in Bullington, U.S. patent application Ser. No. 11/782,120, which application is commonly assigned with the present application and is incorporated herein by reference.

In this arrangement, the rotator assemblies are mounted to a carriage that reciprocates all of the assemblies into and out of the strap path. Although such an arrangement has been found to work well for rotating the strap joint, the assemblies are large and relatively heavy and can exert unneeded stresses on the strapping machine. Moreover, the laterally moving rotator assemblies can inadvertently move the straps laterally, out of the strap path.

Accordingly, there is a need for a multi-head strapping machine for compressible loads that includes a strap joint rotator that exerts lesser stresses on the strapping machine. Desirably, such a strap joint rotator facilitates and assists in maintaining the strap joint aligned in the strapping portion of the machine. More desirably, such a strap joint rotator is of a sufficiently small profile to minimally, if at all, impact the machine size.

BRIEF SUMMARY OF THE INVENTION

A strap joint rotating assembly is used with a strapping machine of the type for feeding a strapping material around a load, positioning, tensioning and sealing the strapping material around the load. The joint rotator is anticipated for use with strapping machines for strapping compressible loads.

The strapping machine is a side sealing machine that has a feed head for feeding the strapping material into the strapping machine, a strap chute through which the strapping material is passed and a sealing head to seal overlapping courses of the strapping material to one another to define a strap loop having a seal and defining a strap loop plane. The strap traverses from the feed head, through the strap chute and sealing head to define a strap path.

The rotating assembly includes a driven wheel having an axis of rotation generally perpendicular to the strap loop plane and a pinch wheel that has an axis of rotation and is carried on a wheel block. The wheel block pivots to move the pinch wheel into and out of the strap loop plane. The pinch wheel, when in the strap loop plane, has its axis of rotation parallel to the axis of rotation of the driven wheel. The pinch wheel is further movable linearly toward the driven wheel to pinch the strap between the driven wheel and the pinch wheel, such that the driven wheel is driven to rotate the strap loop and the seal around the load.

In a present embodiment, the driven wheel is positionally fixed, preferably within a portion of the strap chute, outside of a periphery of the strap loop, and is only rotatable about is axis of rotation.

In an embodiment, a wheel support is carried in the wheel block and is mounted in the wheel block for pivotal movement with the wheel block into and out of the strap loop plane and for linear movement within the wheel block toward and away from the driven wheel. The wheel support is biasedly mounted within the wheel block.

A compression block can be mounted to the wheel block and positioned such that at least a portion of the wheel support is disposed between the compression block and the wheel block. In such an arrangement, the wheel support is biasedly mounted between the compression block and the wheel block.

The wheel block is mounted to a carriage that is mounted to the strapping machine. The wheel block pivots on the carriage into and out of the strap loop plane. A linkage operably connects to the carriage and the wheel block.

In a strapping machine in which multiple straps are simultaneously positioned and sealed around the load using multiple strap chutes, strapping and feed heads, a strap joint rotator assembly is associated with each such chute, strapping and feed head unit. In this arrangement, the driven wheels are driven from a common drive to properly execute rotator timing. An actuating bar is configured for reciprocating movement and is operably connected to linkages associated with each pinch wheel. Reciprocation of the actuating bar in a first direction pivots the wheel blocks to move the pinch wheels into their respective strap loop planes, and further movement of the actuating bar in the first direction moves the wheel supports linearly to engage the pinch wheels with their driven wheels. Reciprocation of the actuating bar in the opposite direction moves the wheel supports and pinch wheels away from their driven wheels and rotates the wheel blocks out of their strap path planes.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of the specification, namely, "Detailed Description Of The Invention", relates to a requirement of the United States Patent Office, and does not imply, nor should be inferred to limit the subject matter disclosed herein.

Figure 1:
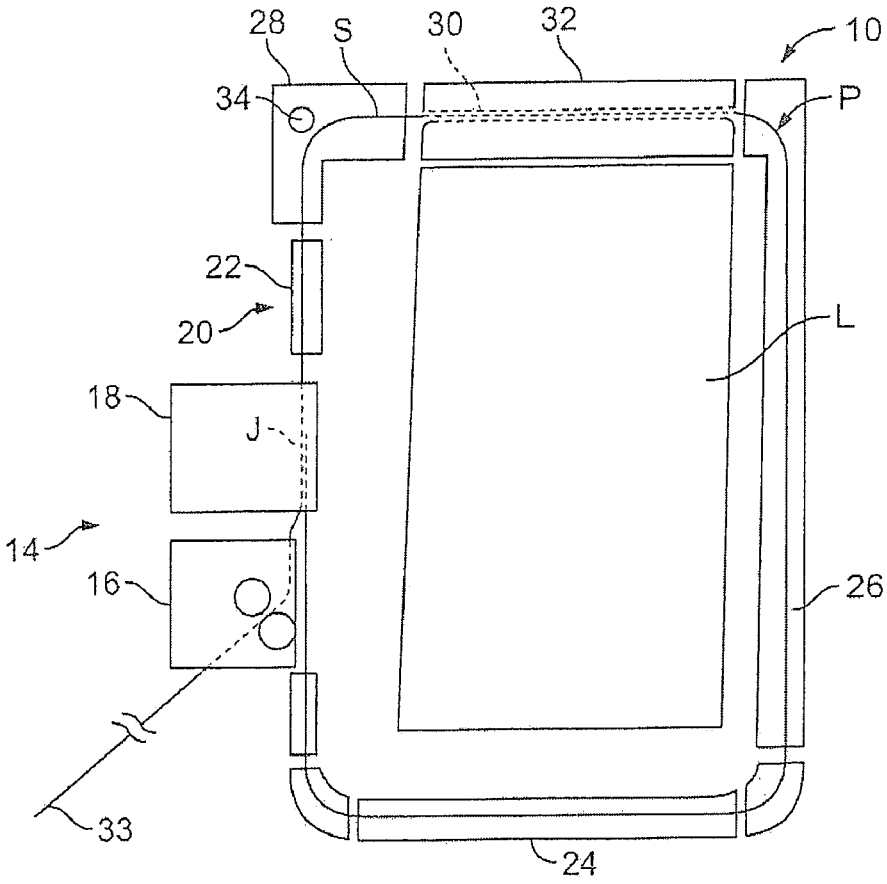
FIG. 1 is a schematic illustration of a strapping machine having a strap joint rotator with pivoting linkage and pinch wheel embodying the principles of the present invention, the machine shown with one strapping unit.
Figure 2:
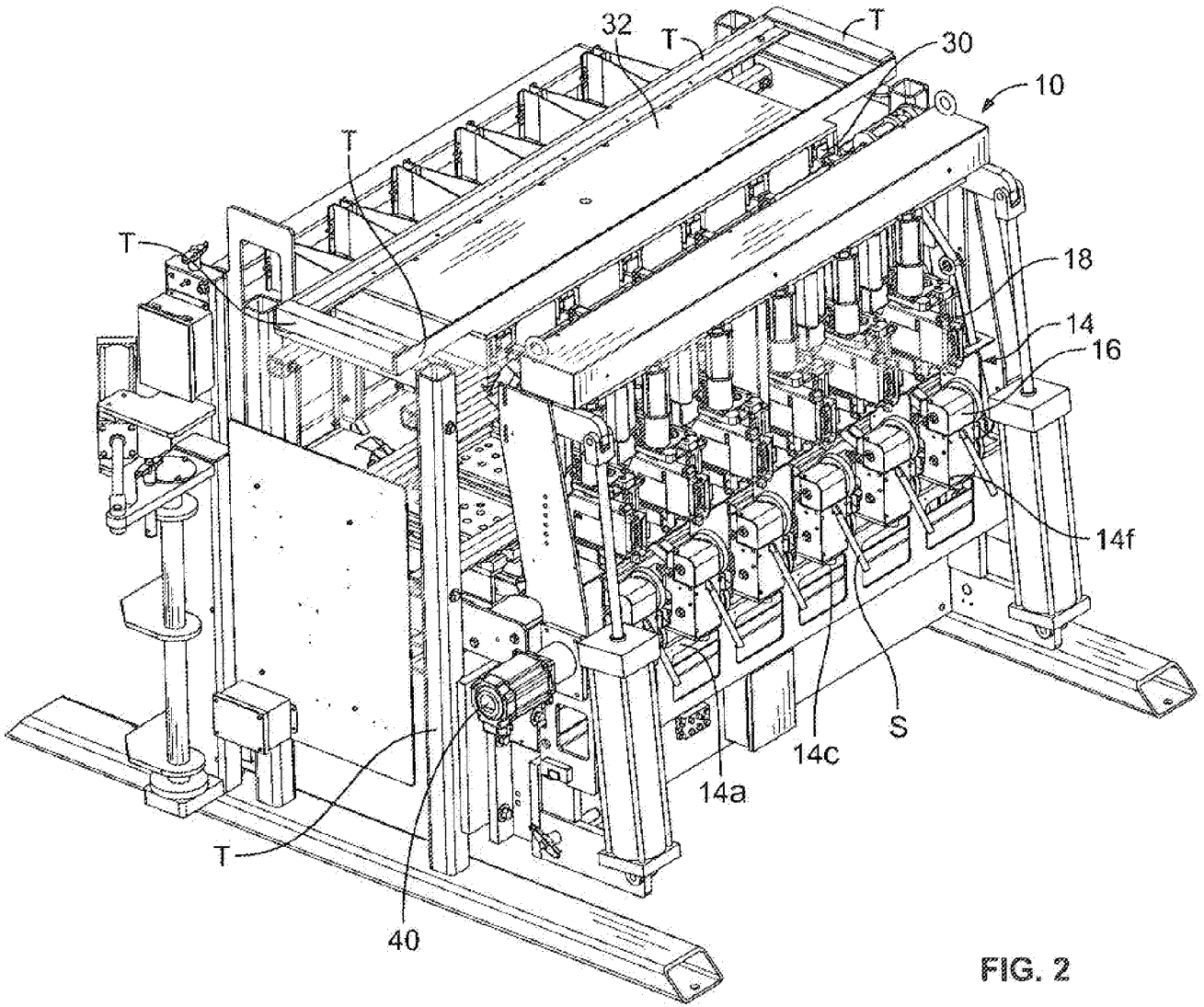
FIG. 2 is a perspective view of the strapping machine.
Figure 3:
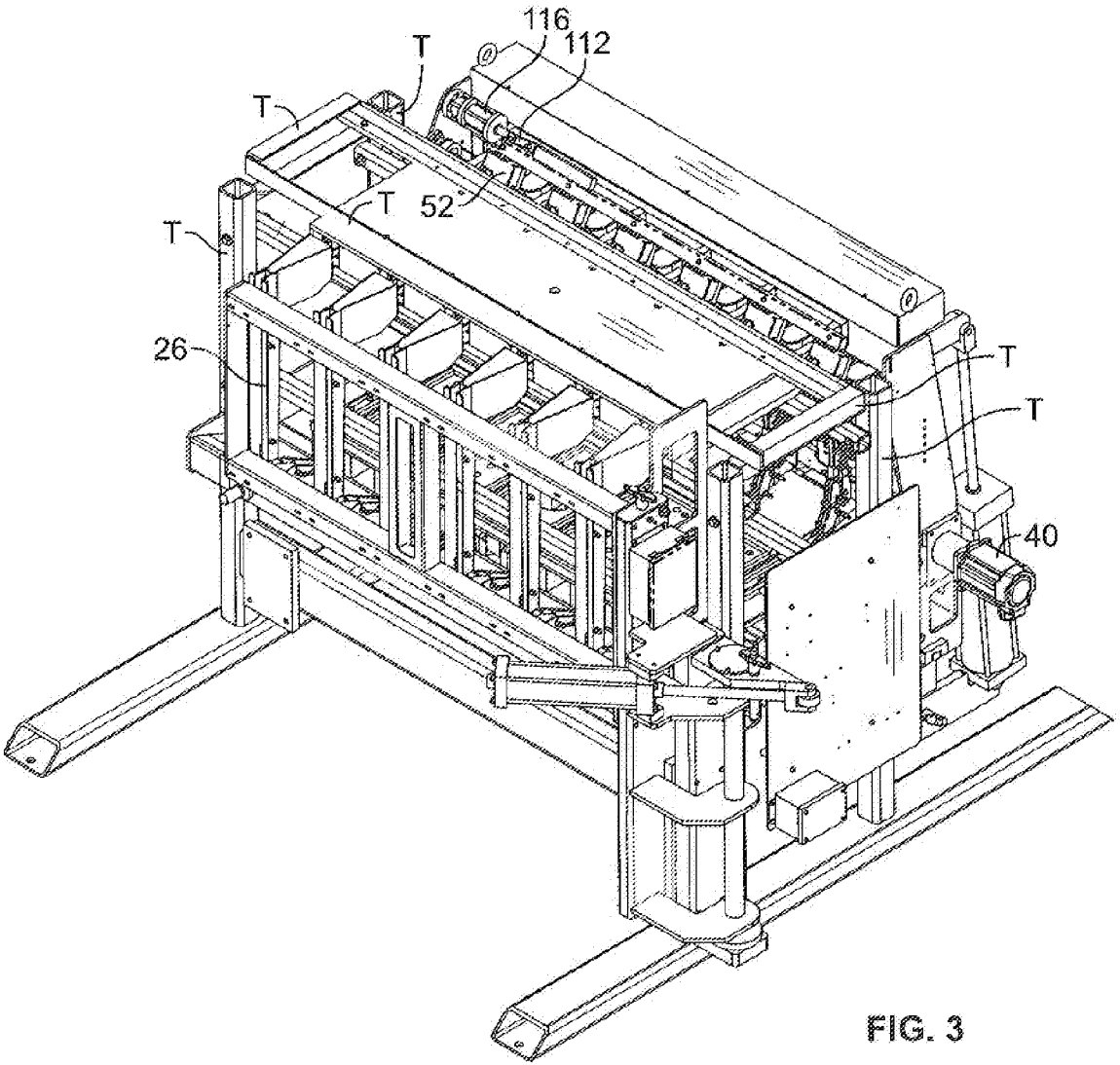
FIG. 3 is an opposite perspective view of the strapping machine.

Referring to the figures and in particular to FIG. 1 there is shown a strapping machine 10 for compressible materials having a pivoting pinch wheel strap rotator 12 in accordance with the principles of the present invention. The machine 10 as shown includes six separate but interdependent strapping units 14*a-f*. Each unit 14 includes a feed head 16 (to feed and retract the strap material S), a sealing head 18, portions of a strap chute 20 including a side leg 22 of the strap chute, a lower portion 24 of the strap chute, an opposite side 26 leg of the strap chute and portions of a transition 28 to an upper portion 30 of the strap chute. It should be noted that the strapper 10 shown in FIGS. 2-3 is illustrated with a test frame T to accommodate testing of the apparatus and the such a test frame T is not part of the operating strapper 10.

An upper compression platen 32 compresses the load L for strapping and includes the upper portion 30 of the strap chute. Also illustrated, for purposes of understanding, in phantom lines, is the bale of strapped material L. It will be understood that although the components of each of the units 14 are presented in singular, the present machine 10 includes six of each of these components, each associated with one of the strapping units 14*a-f*.

Figure 4:
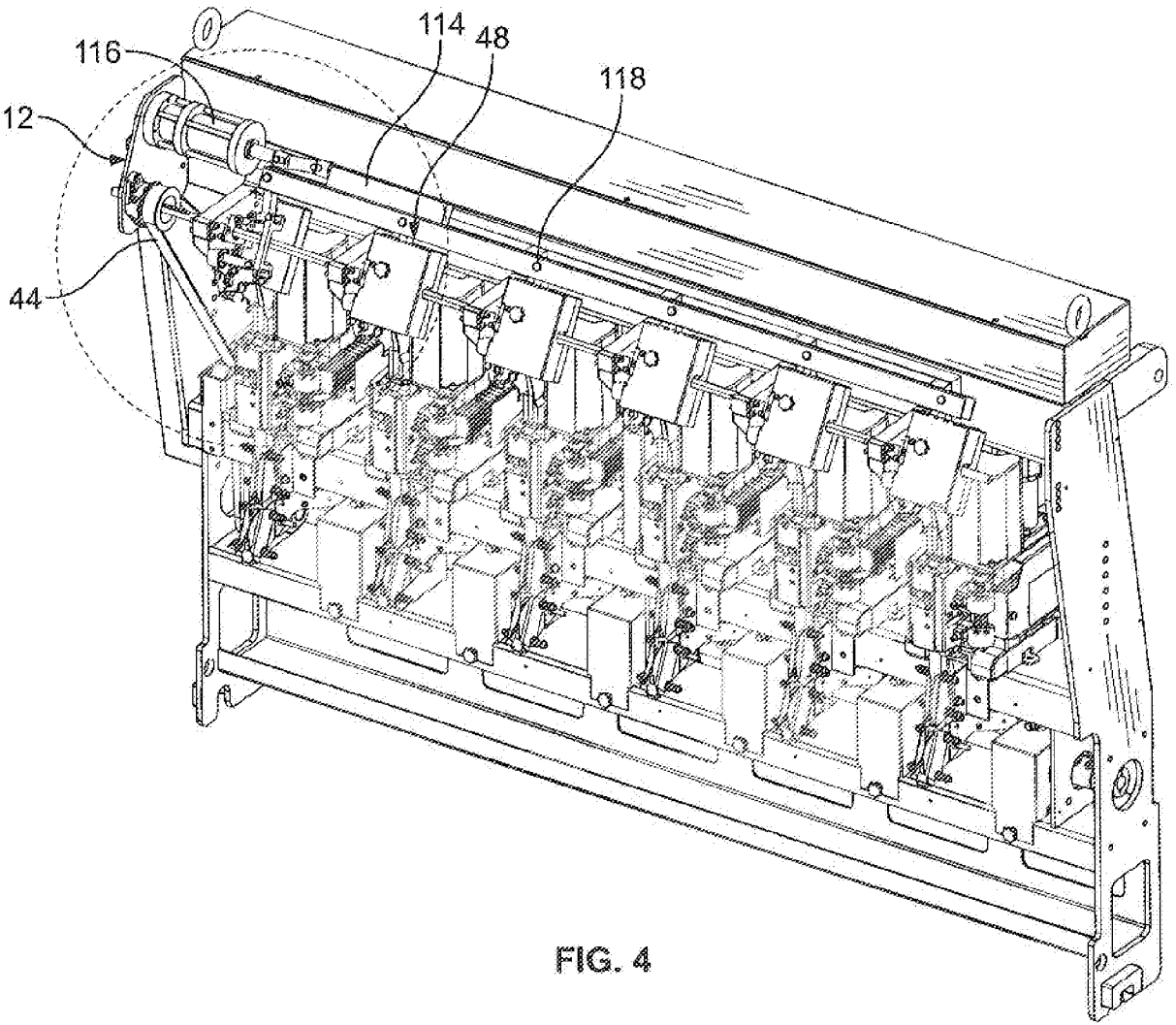
FIG. 4 is a perspective view of the front or sealing head side of the strapping machine as seen from the inside of the machine.
Figure 4A:
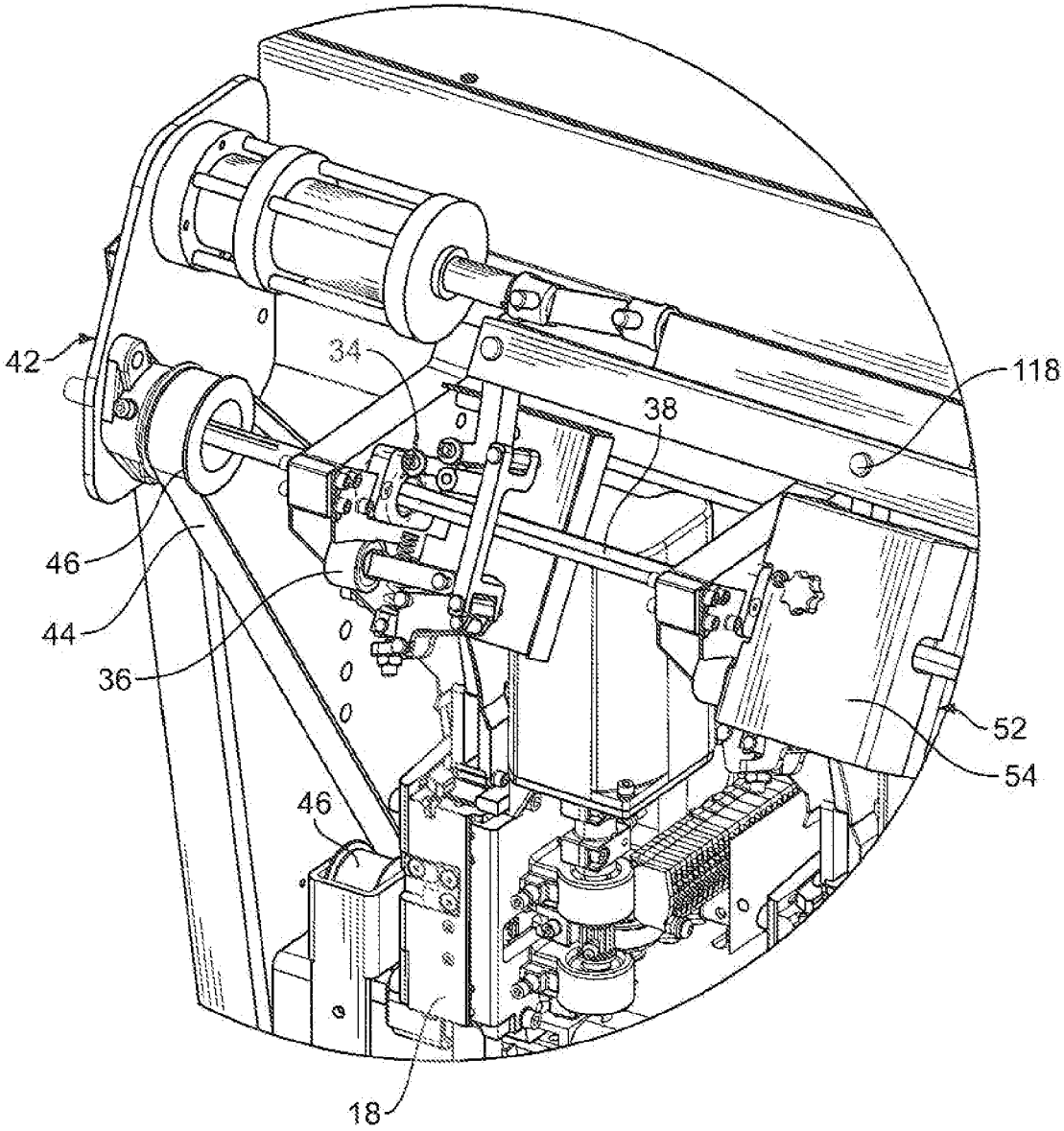
FIG. 4A is an enlarged view of the area designated in FIG. 4, showing the common drive and the actuating bar drive.
Figure 5:
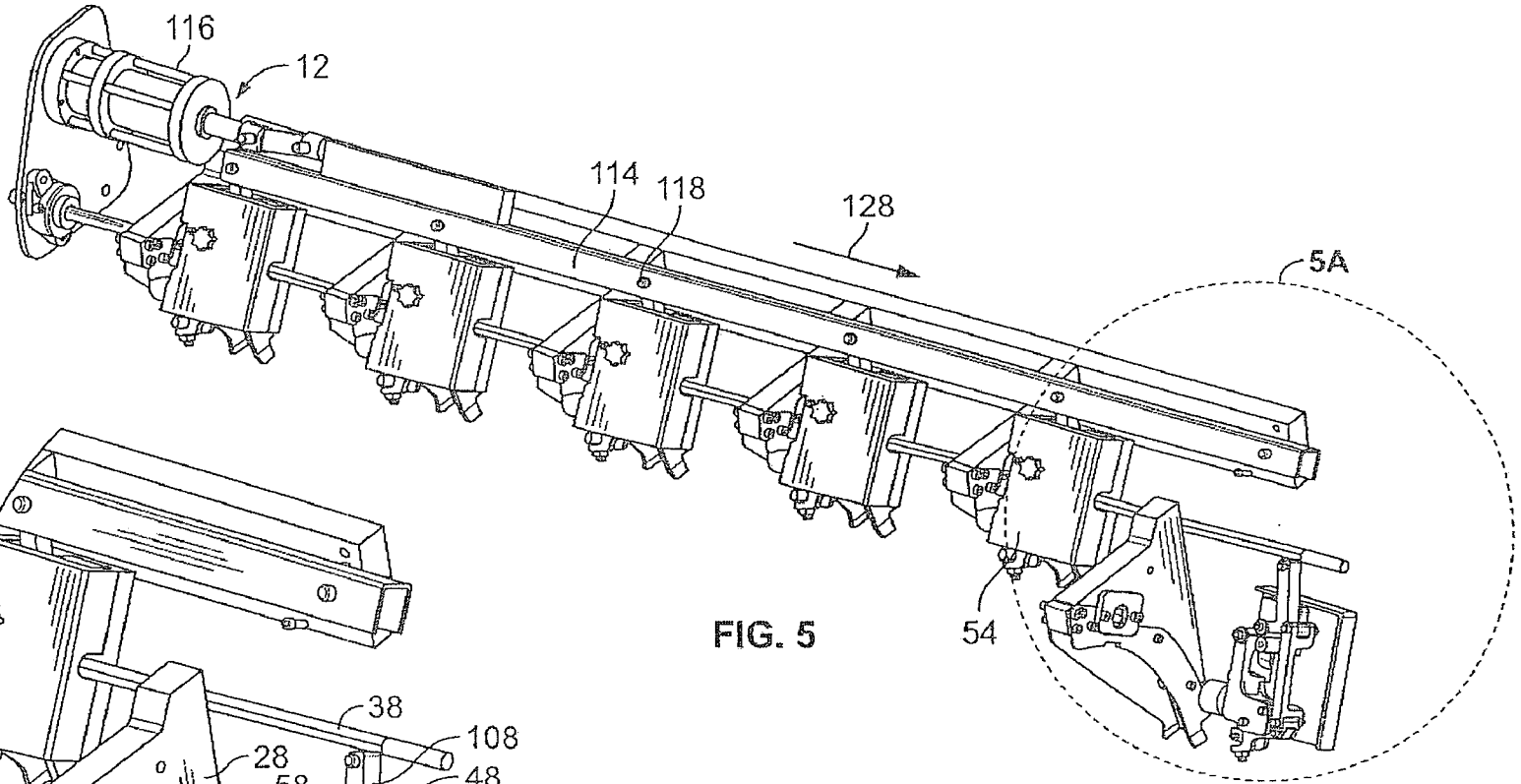
FIG. 5 is partial perspective view of the pivot assemblies and the drives, with one of the assemblies shown with the enclosure cover removed.
Figure 5A:
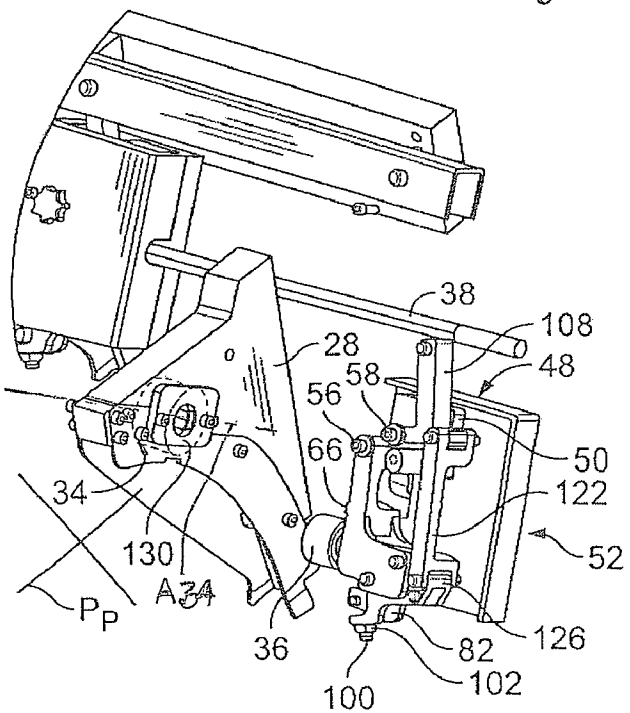
FIG. 5A is an enlarged view of the areas designated in FIG. 5, showing the pivot assembly in the engaged position.
Figure 6A:
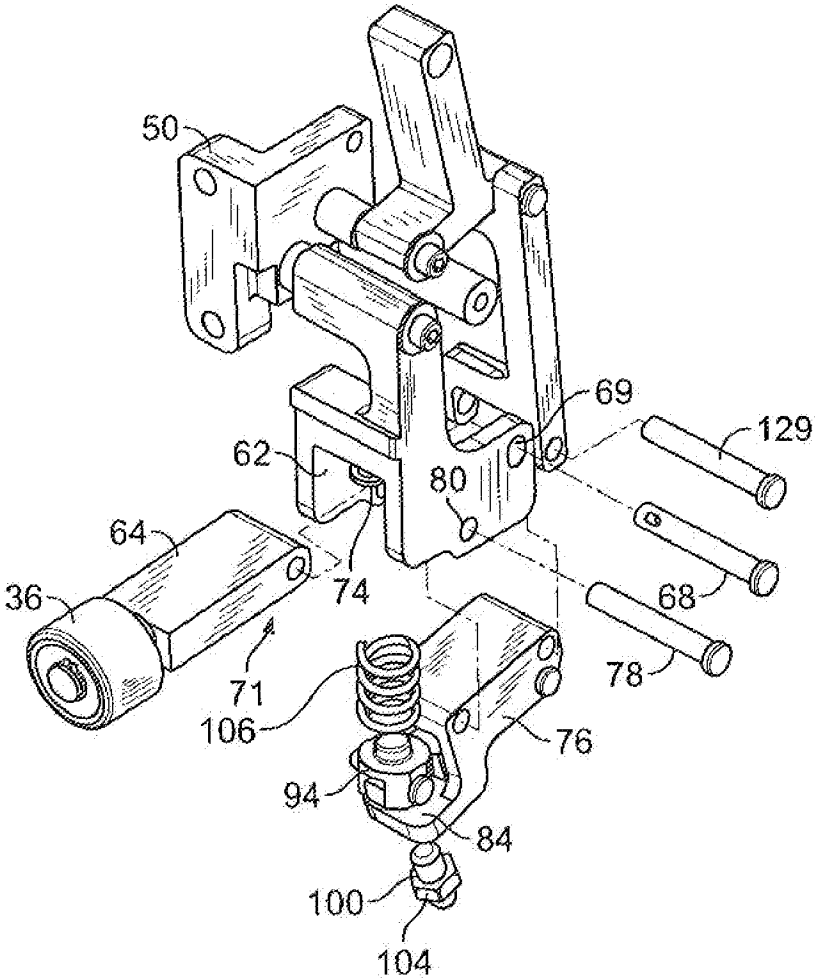
FIGS. 6A-6D are exploded views of portions of the pivot assembly of FIG. 6.
Figure 6:
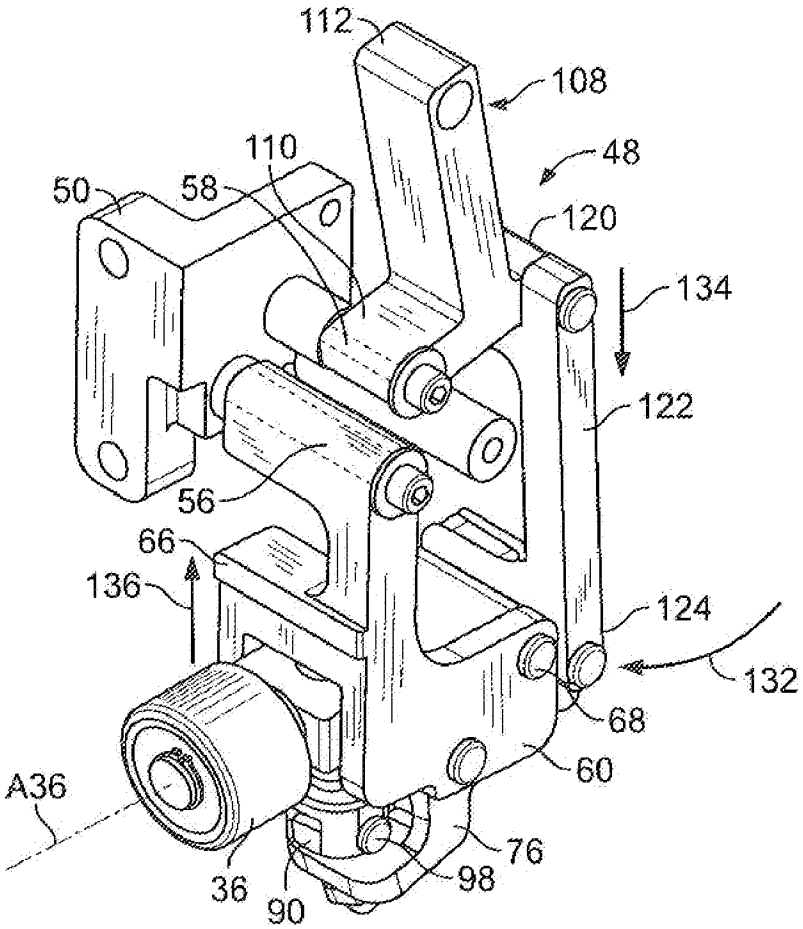
FIG. 6 is a perspective view of the pivot assembly.
Figure 6B:
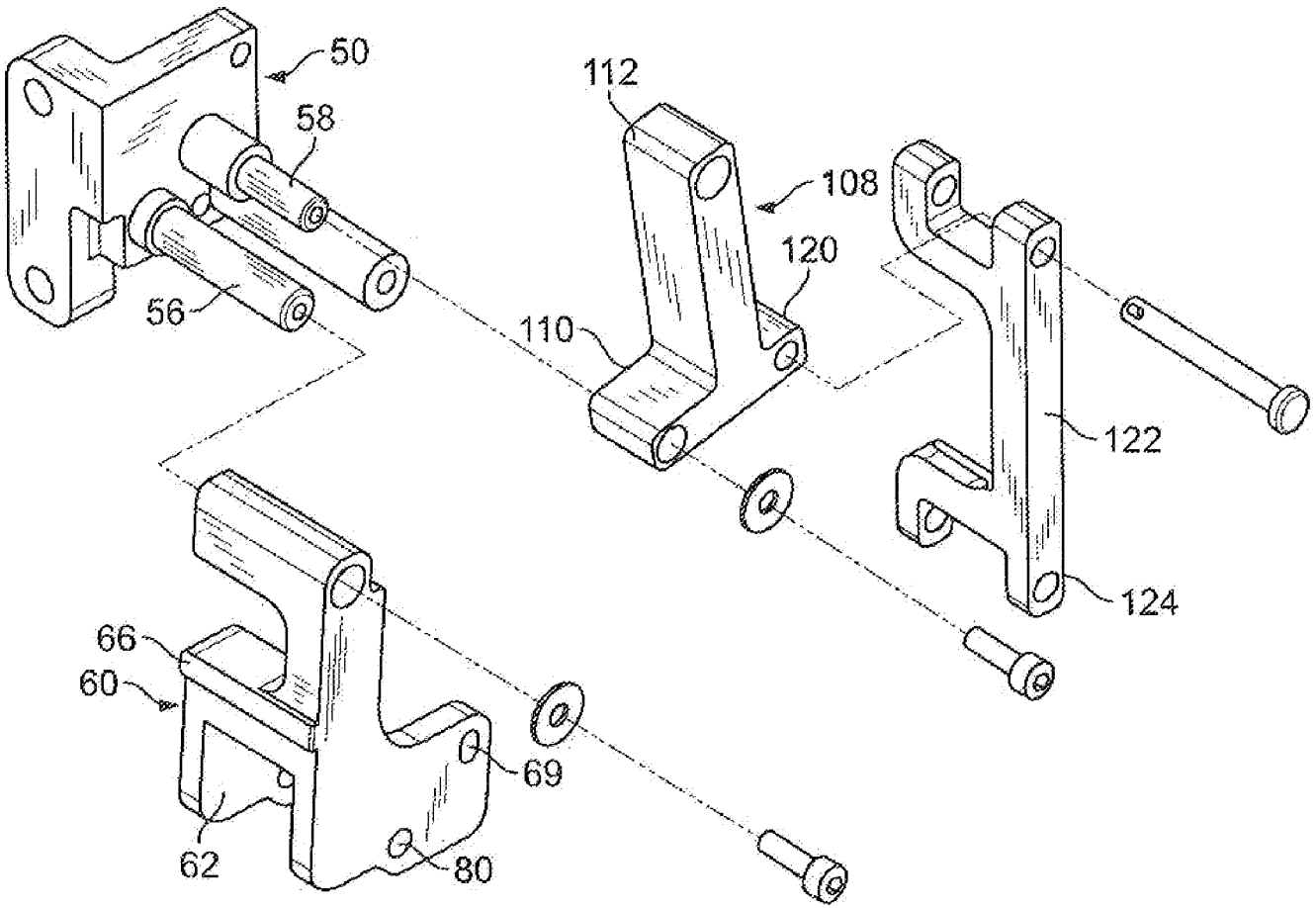
Figure 6C:
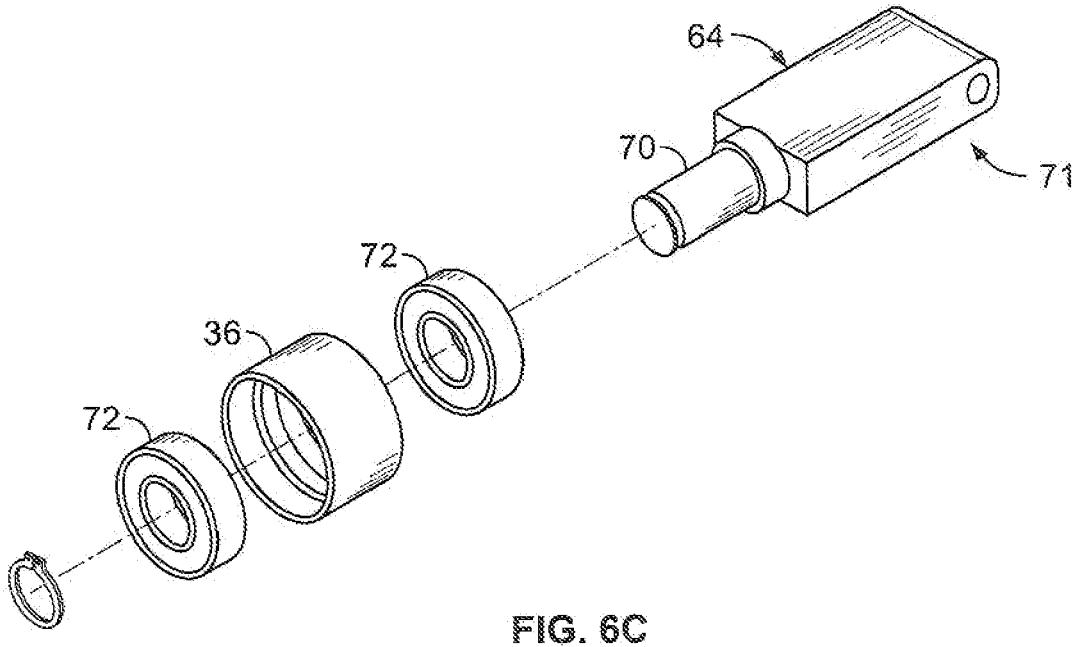
Figure 6D:
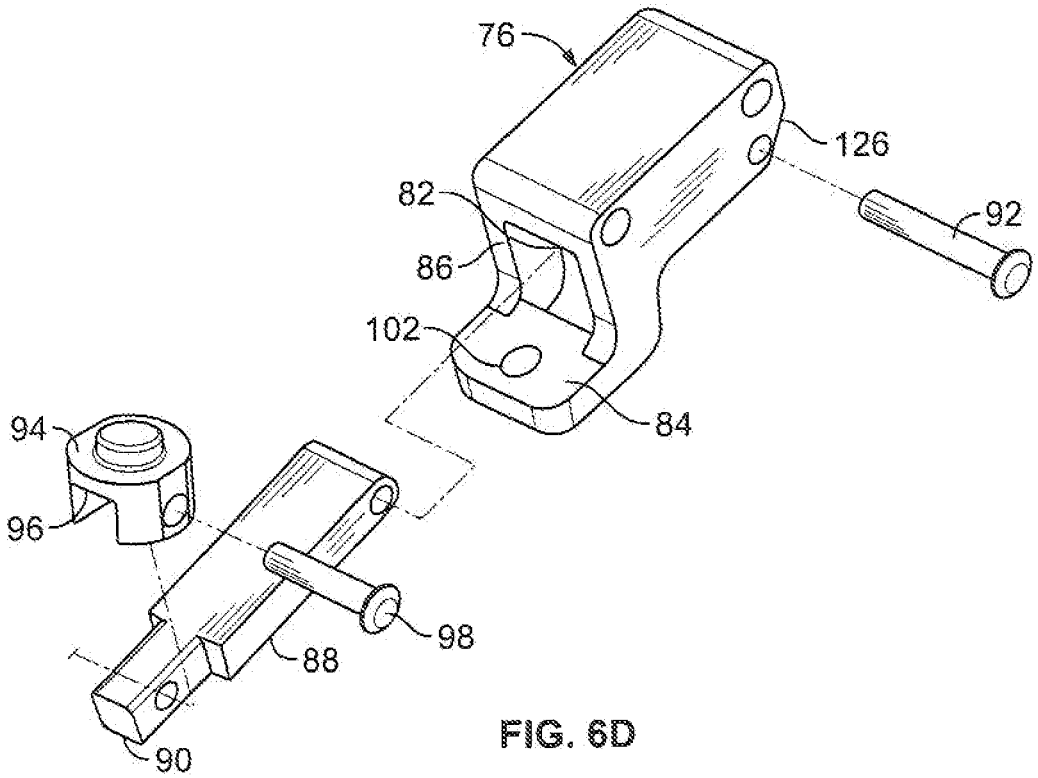

Referring to FIGS. 4-6, the strap rotator or strap joint rotator is illustrated generally at 12. A strap rotator 12 is associated with each of the strapping assemblies 14. The rotator 12 includes a driven wheel 34 positioned within a fixed portion of the strap chute 20 at a transition 28 of the chute from the side leg 22 to the upper leg 30 (which is within the platen 32) and a pinch wheel 36 that moves into and out of engagement with the driven wheel 34. The driven wheel 34, which is located just at an outer periphery of the strap path P, is commonly driven with the other driven wheels 34 by a common drive shaft 38.

A rotator drive 40 is located at a side 42 of the strapping machine 10. A belt 44 is positioned around a plurality of wheels 46, one of which 46 is positioned on the drive 40 and another 46 on the drive shaft so that each of the driven wheels 34 is driven at the same speed as each other. The pinch wheel 36 is mounted on a pivot assembly 48 for movement into and out of engagement with the driven wheel 34. The pivot assembly 48 includes a pivot carriage 50 that is mounted within a covered enclosure 52 (e.g., has a removable cover 54) to prevent contamination and to enclose the moving (pivoting) parts.

Referring to FIGS. 6A-6D, the pivot carriage 50 includes a pair of pivot pins 56, 58 extending therefrom. A wheel block 60 is pivotally mounted to the pivot carriage 50 at one of the pivot pins 56. The wheel block 60 includes a lower recess 62 into which a wheel support 64 is mounted. The wheel block 60 includes a front stop surface 66 to, as will be described below, stop forward rotation of the wheel block 60. The wheel support 64 is mounted to the block 60 by a pivot pin 68 at a rear end of the support 64. Importantly, the openings 69 in the wheel block 60 through which the pin 68 traverses are slotted. This permits the pivot end 71 of the wheel support 64 to move up and down as well as to pivot.

A stub 70 extends from a front of the wheel support 64 on which bearings 72 and the pinch wheel 36 are mounted for free rotation of the pinch wheel 36. A compression spring 74 is positioned between wheel support 64 and the wheel block 60 to bias the wheel support 64 away from the wheel block 60.

A compression block 76 is pivotally mounted at pivot 78, to the wheel block 60 at about an intermediate location, as indicated at about 80, along the compression block 76 such that the wheel support 64 is maintained in the wheel block recess 62 by the compression block 76 (the compression block 76 also fits, in part, in the wheel block recess 62). The compression block 76 includes a recess 82 and a lower spring retainer surface 84. A channel 86 is formed at an end of the recess 82 that opens to the lower spring retainer surface 84.

A lower pivot clevis 88 is fitted into the compression block recess 82 such that a narrowed forward end 90 of the lower pivot clevis 88 extends through the compression block channel 86 and onto the lower spring retainer surface 84. A rear end of the lower pivot clevis 88 is mounted to the compression block by a pivot pin 92. In this arrangement, the lower pivot clevis 88 is maintained in the compression block 76, but is allowed to pivot with the compression block 76.

A spring retainer 94 is positioned on the lower spring retainer surface 84 and includes a notch 96 therein such that the spring retainer 94 fits over the pivot clevis forward end 90 and rests on the lower spring retainer surface 84. The spring retainer 94 is secured to the pivot clevis 88 by a pivot pin 98 to allow the spring retainer 94 to pivot on the pivot clevis 88.

A threaded rod 100 is positioned in an opening in 102 the lower spring retainer surface 84 and abuts or contacts the narrowed pivot clevis forward end 90. A lock nut 104 is threaded onto the rod, below the lower surface to secure the rod 100 at a desired threaded depth.

A die spring 106 is positioned on the spring retainer 94 and is fitted between the retainer 94 and the wheel support 64. This maintains a bias between the lower pivot clevis 88 and the wheel support 64. In this manner, the wheel support 64 floats in the wheel block recess 62 between the wheel block 60 and the compression block 76, and is maintained in place by the compression spring 74 and the die spring 106. The thread depth of the rod 100 can be changed to adjust the compression in the die spring 106 by varying the distance between the retainer 94 (pivot clevis 88) and the lower spring retainer surface 84.

An actuating link 108 is a three-point link and is mounted at one point 110 to the carriage 50 (a fixed pivot) and is mounted at a second end 112 to an actuating bar 114 that connects the pivot assemblies 48 to one another. The actuating bar 114 is actuated by a cylinder 116 that is mounted to the strapping machine 10. Pivot pins 118 connect the actuator bar 114 to each of the pivot assembly actuating links 108.

The third position 120 on the actuating link 108 is pivotally mounted to a pivot link 122. The pivot link 122 is mounted at its other end 124 to the back end 126 of the compression block 76 by pin 129 (just above where the pivot clevis 88 is mounted to the compression block 76).

The pivot assembly 48 moves through two movements into one of three positions. The two movements can be viewed as an arcuate movement and a linear movement. The first or arcuate movement pivots the entire assembly 48 from a disengaged position (a first position) in which the pinch wheel 36 is out of the plane $P_P$ of the strap path P to bring the pinch wheel 36 into the strap path plane $P_P$. In this second position (or guide position), the pinch wheel 36 lies in the plane $P_P$ of the strap path P, but is not engaged with the drive wheel 34. The axes of the driven wheel $A_{34}$ and the pinch wheel $A_{36}$ are essentially parallel when the pinch wheel 36 is in the guide position.

The second or linear movement is at the end of the first movement and moves the pinch wheel 36 from the guide position to bring the pinch wheel 36 into engagement with the driven wheel 34 (or the strap S when it is positioned between the wheels 34, 36), in an engaged position. This parallel movement is to prevent the pinch wheel 36 from contacting the driven wheel 34 (and the strap S) at a corner first, and then "rolling" the remainder of the pinch wheel 36 into contact with the driven wheel 34 (and/or strap S).

To this end, it will be appreciated that movement of the actuating bar 114 in the direction indicated by the arrow at 128, rotates the actuating link 108 counterclockwise which moves the pivot link 122 up, to pivot the rotator pivot assembly 48 (pivot wheel block 60) counterclockwise, out of the plane $P_P$ of the strap path P to the disengaged position.

Conversely, when the actuating bar 114 reciprocates in the direction opposite the arrow 128, the actuating link 108 is rotated clockwise. This pushes the pivot link 122 down, which pivots the rotator pivot assembly 48 (pivot wheel block 60) clockwise. The wheel block 60 pivots about the pivot indicated at 56. This brings the pinch wheel 36 into the plane $P_P$ of the strap path P (moves the pinch wheel 36 from the disengaged position to the guide position). It will be appreciated that this movement defines an arcuate path (see FIG. 6, arrow at 132), and as such, the axis of rotation $A_{36}$ of the pinch 36 wheel is non-parallel to the axis of rotation $A_{34}$ of the driven wheel 34. The arcuate movement is stopped by the contact of the stop surface 66 with the fixed portion of the strap chute 20 at the transition 28, the engagement location being indicated generally by the arrow at 130.

As the actuating bar 114 continues to move in the direction opposite the arrow at 128, the forward movement of the wheel block 60 is stopped by contact between the stop surface 66 and the chute transition 28. At this point in the cycle, the pivot assembly 48 (e.g., the pinch wheel 36) is in the guide position. However, as the pivot link 122 continues to push down on the end of the compression block 76 (see arrow at 134), because the wheel support 64 is captured between the wheel block 60 and the compression block 76, the downward force from the compression block 76 is transmitted into an upward force on the wheel support 64. Since the wheel support 64 is biasedly supported between the wheel block 60 and the compression block 76, and because the openings 69 in the wheel block 60 through which the wheel support pivot pin 68 fits are slotted, this results in an upward movement (see arrow at 136) of the wheel support 64, as assisted by the die spring 106. This linear movement of the wheel support 64 and the pinch wheel 36, is such that the terminal movement of the pivot wheel 36 from the guide position to the engaged position (to capture the strap S) is a linear movement of the pivot wheel 36, with the pivot wheel 36 and driven wheel 34 axes $A_{36}$, $A_{34}$ parallel to one another so that essentially the entire surfaces of the wheels 36, 34 contact one another.

In the overall operation of the strapping machine 10, the load L is loaded into the strapping machine 10 with the frame portions closed and the compression platen 32 in place. The load is compressed. With the load compressed, the rotator pivot assembly 48 is pivoted to the guide position, with the pinch wheel 36 in the plane $P_P$ of the strap path P, but spaced from the drive wheel 34.

The strapping cycle commences with strap S being fed, in a predetermined length, by the feed head 16, from the strap supply 33 through the sealing head 18, through and around the strap chute 20 (include the top leg portion 30 in the compression platen 32), and back to the sealing head 18. In the sealing head 18, the lead end of the strap S is gripped, and the feed head 16 reverses to retract the strap S. Retracting the strap pulls the strap from the strap chute 20 onto the load L. It should be noted that the strap S is retracted, but is not tensioned about the load L. It should also be noted that with the pinch wheel 36 in the guide position, it is spaced from the drive wheel 34 and the pinch wheel 36 actually serves as part of the guide for the strap S to properly traverse through the chute 20. This prevents the strap S from being inadvertently misdirected out of the chute 20 at about the transition 28 from the side leg 22 to the top leg 30 (in the platen 32).

With the strap S retracted, the intermediate section of the strap is gripped (at this point in the cycle both "ends" of the strap S are gripped), the feed end is cut from the strap supply 33 and the strap courses are welded to one another in the sealing head 18.

The actuator bar 114 then moves to move the rotator pivot assembly 48 from the guide position to the engaged position so that the strap S is captured between the pinch and drive wheels 34, 36, and the drive 40 is actuated to rotate the strap joint J to the desired position. The pivot assembly 48 is then moved to the disengaged position (rotated out of the plane $P_P$ of the strap path P), the compression platen 32 is raised to release the bale L, and the bale L is ejected from the machine 10.

It will be appreciated that when the strap S is rotated, the strap S is still in a relaxed state, that is, prior to the bale L being allowed to expand. It is only after the bale L is allowed to expand that tension is exerted on the strap S. And, because the strap S has been rotated so that the joint J is not in the same direction as the natural expansion of the bale L, less stress is exerted on the joint J. Moreover, the load L is often handled and transported with the bale L on its side. As such, positioning the seal or joint J at the top or bottom of the bale L reduces the likelihood that the seal J will contact the floor or possibly become caught on the floor surface or a load stacked on top of or under the instant bale L.

Moreover, in that the present strapping machine 10 uses modular feed and sealing or strapping heads 16, 18 (such as those disclosed in Flaum, et al., U.S. Pat. No. 6,755,123 and Flaum et al., U.S. Pat. No. 6,584,892, and their related patents, all of which are commonly assigned with the present invention and all of which are incorporated herein by reference), the machine 10 is readily maintained and less complex than known baling machines. The present strapping machine 10 uses an automatic refeed arrangement, which will be recognized by those skilled in the art.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strap joint rotating assembly for use with a strapping machine of the type for feeding a strapping material around a load, positioning, tensioning and sealing the strapping material around the load, the strapping machine having a feed head for feeding the strapping material into the strapping machine, a strap chute through which the strapping material is passed and a sealing head to seal overlapping courses of the strapping material to one another to define a strap loop having a seal and defining a strap loop plane, the strapping material traversing from the feed head, through the strap chute and sealing head to define a strap path, the strap joint rotating assembly, comprising:

a driven wheel having an axis of rotation generally perpendicular to the strap loop plane, the driven wheel positioned within a fixed portion of the strap chute;

a pinch wheel has an axis of rotation and is carried on a wheel block, the wheel block pivots to move the pinch wheel into and out of the strap loop plane, the movement of the pinch wheel into the strap loop plane defines an arcuate path, in which the rotation axis of the pinch wheel is not parallel to the rotation axis of the driven wheel, the pinch wheel, when in the strap loop plane, having its axis of rotation parallel to the axis of rotation of the driven wheel, the pinch wheel being further movable linearly upwardly toward the driven wheel to pinch the strapping material between the driven wheel and the pinch wheel, wherein the driven wheel is driven to rotate the strap loop around the load and to reposition the seal around the load.

2. The strap joint rotating assembly in accordance with claim 1 wherein the driven wheel is positionally fixed and is only rotatable about is axis of rotation.

3. The strap joint rotating assembly in accordance with claim 2 wherein the driven wheel is disposed within the portion of the strap chute, outside of a periphery of the strap loop.

4. The strap joint rotating assembly in accordance with claim 1 including a wheel support carried in the wheel block, the wheel support being mounted in the wheel block for pivotal movement with the wheel block into and out of the strap loop plane and for linear movement within the wheel block toward and away from the driven wheel.

5. The strap joint rotating assembly in accordance with claim 4 wherein the wheel support is biasedly mounted within the wheel block.

6. The strap joint rotating assembly in accordance with claim 4 including a compression block mounted to the wheel block and positioned such that at least a portion of the wheel support is disposed between the compression block and the wheel block.

7. The strap joint rotating assembly in accordance with claim 6 wherein the wheel support is biasedly mounted between the compression block and the wheel block.

8. The strap joint rotating assembly in accordance with claim 2 wherein the driven wheel forms a part of the strap chute.

9. The strap joint rotating assembly in accordance with claim 1 wherein the wheel block is mounted to a carriage mounted to the strapping machine, the wheel block pivoting on the carriage.

10. The strap joint rotating assembly in accordance with claim 9 including a linkage operably connected to the carriage and the wheel block.

11. The strap joint rotating assembly in accordance with claim 10 including an actuating bar configured for reciprocating movement, the actuating bar operably connected to the linkage, wherein reciprocation of the actuating bar in a first direction pivots the wheel block into the strap loop plane, further movement of the actuating bar in the first direction moves the wheel support linearly to engage the pinch wheel with the driven wheel, and wherein reciprocation of the actuating bar in an opposite direction moves the wheel support and pinch wheel away from the driven wheel and rotates the wheel block out of the strap path plane.

12. A strapping machine of the type for concurrently feeding multiple straps around a load, positioning, tensioning and sealing the straps around the load to form strap loops, the strap loops defining respective strap loop planes, the strap loops being sealed at respective seals, and rotating the straps around the load to reposition the respective seals, comprising:

a frame;

a plurality of side-by-side strap chutes;

a plurality of feed systems each for feeding strapping material into their respective strap chutes;

a plurality of sealing heads each for receiving their respective strapping material, and sealing the strapping material to itself in overlaying courses to define respective strap seals; and a strap joint rotator including a plurality of strap joint rotating assemblies, each of the assemblies operably connected to the frame, each of the assemblies including a driven wheel having an axis of rotation generally perpendicular to a respective strap loop plane and a pinch wheel having an axis of rotation, the driven wheel positioned within a fixed portion of the respective strap chutes, the pinch wheel being carried on a wheel block, the wheel block pivoting to move the pinch wheel into and out of the respective strap loop planes, the movement of the pinch wheel into the respective strap loop planes defines an arcuate path, in which the rotation axis of the pinch wheel is not parallel to the rotation axis of the driven wheel, the pinch wheel, when in the strap loop plane, having its axis of rotation parallel to the axis of rotation of the driven wheel, the pinch wheel being further movable linearly upwardly toward the driven wheel to pinch the strapping material between the driven wheel and the pinch wheel, wherein the driven wheels are driven, as one, to rotate the strap loops around the load to reposition their respective seals around the load.

13. The strapping machine in accordance with claim 12 including a common drive for driving each of the driven wheels simultaneously and at a common speed.

14. The strapping machine in accordance with claim 13 wherein each driven wheel is positionally fixed and is only rotatable about is axis of rotation.

15. The strapping machine in accordance with claim 14 wherein each driven wheel is disposed within the portion of its strap chute, outside of a periphery of its strap loop.

16. The strapping machine in accordance with claim 12 wherein each of the strap joint rotating assemblies includes a linkage operably connected thereto for pivoting the wheel block to move the pinch wheel into and out of the respective strap loop planes, and for linearly moving the pinch which toward and away from the driven wheel.

17. The strapping machine in accordance with claim 16 including an actuating bar and wherein the actuating bar is operably connected to each of the strap joint rotating assembly linkages.

18. The strapping machine in accordance with claim 17 including an actuating bar drive for reciprocatingly driving the actuating bar.

19. The strapping machine in accordance with claim 18 wherein the actuating bar drive is a reciprocating cylinder.

* * * * *

UNITED STATES PATENT AND TRADEMARK OFFICE

CERTIFICATE OF CORRECTION

PATENT NO. : 7,421,944 B1
APPLICATION NO. : 12/056811
DATED : September 9, 2008
INVENTOR(S) : Flaum et al.

It is certified that error appears in the above-identified patent and that said Letters Patent is hereby corrected as shown below:

Claim 2, Column 8, Line 6 should read, --only rotatable about its axis of rotation.--

Claim 14, Column 9, Line 23 should read, --rotatable about its axis of rotation.--

Claim 16, Column 10, Line 9 should read, --strap loop planes, and for linearly moving the pinch wheel--

Signed and Sealed this

Twenty-eighth Day of October, 2008

JON W. DUDAS
*Director of the United States Patent and Trademark Office*